US008365981B1

(12) United States Patent
Perlsweig

(10) Patent No.: US 8,365,981 B1
(45) Date of Patent: Feb. 5, 2013

(54) DEVICE FOR SUPPORTING A SECOND PIZZA IN A PIZZA BOX AND METHOD OF USE

(76) Inventor: Leon Perlsweig, Woodland Hills, CA (US)

( * ) Notice: Subject to any disclaimer, the term of this patent is extended or adjusted under 35 U.S.C. 154(b) by 0 days.

(21) Appl. No.: 13/333,417

(22) Filed: Dec. 21, 2011

(51) Int. Cl.
*B65D 25/04* (2006.01)

(52) U.S. Cl. ..... 229/120.32; 229/120.18; 229/931

(58) Field of Classification Search ..... 229/120.18, 229/120.19, 120.21, 120.28, 120.32, 931; 426/119
See application file for complete search history.

(56) References Cited

U.S. PATENT DOCUMENTS

| | | | | | |
|---|---|---|---|---|---|
| 1,142,017 | A | * | 6/1915 | Brown | 229/120.32 |
| 1,708,890 | A | * | 4/1929 | Lowe | 229/120.32 |
| 2,139,845 | A | * | 12/1938 | Neely | 229/931 |
| 2,517,756 | A | * | 8/1950 | Zabriskie et al. | 229/939 |
| 2,565,146 | A | * | 8/1951 | Okon | 229/120.32 |
| 4,957,237 | A | * | 9/1990 | Madonna et al. | 229/906 |
| 5,002,221 | A | | 3/1991 | Ragan | |
| 5,049,710 | A | | 9/1991 | Prosise | |
| 5,351,880 | A | | 10/1994 | Goudreau | |
| 5,445,314 | A | * | 8/1995 | Newsome | 229/120.21 |
| D362,803 | S | | 10/1995 | McMullen | |
| 5,950,912 | A | | 9/1999 | Economopoulos | |
| 6,290,122 | B1 | | 9/2001 | Correll | |
| 6,386,440 | B1 | | 5/2002 | Tulkoff | |
| 6,748,722 | B2 | | 6/2004 | Correll | |
| 6,764,700 | B2 | | 7/2004 | Lamp | |
| 6,915,949 | B1 | | 7/2005 | Economopoulos | |
| 7,331,459 | B2 | | 2/2008 | Hilbourne | |
| 7,621,439 | B2 | * | 11/2009 | McClure | 229/120.32 |
| 2002/0079357 | A1 | * | 6/2002 | Tulkoff | 229/120.32 |

* cited by examiner

*Primary Examiner* — Gary Elkins
(74) *Attorney, Agent, or Firm* — Timothy Thut Tyson; Ted Masters; Leon D. Rosen & Associates

(57) ABSTRACT

A device is disclosed for supporting a second pizza in a rectangular pizza box which contains a first pizza, the pizza box having four corner zones. The device comprises a rectangular platform which is shaped and dimensioned to be received by the pizza box. The platform has at least four tabs which are selectively positionable to a support position which is substantially perpendicular to the platform, The tabs are located on the platform so that when the tabs are placed in the support position and the platform is placed inside the pizza box, at least one tab will rest upon each corner zone. In one embodiment, the platform includes four tabs; in another embodiment the platform includes eight tabs; and, in another embodiment the tabs include side tabs which can be folded to create a U-shaped support.

10 Claims, 14 Drawing Sheets

20
22
24
26
28
30
32
6

Fig. 15
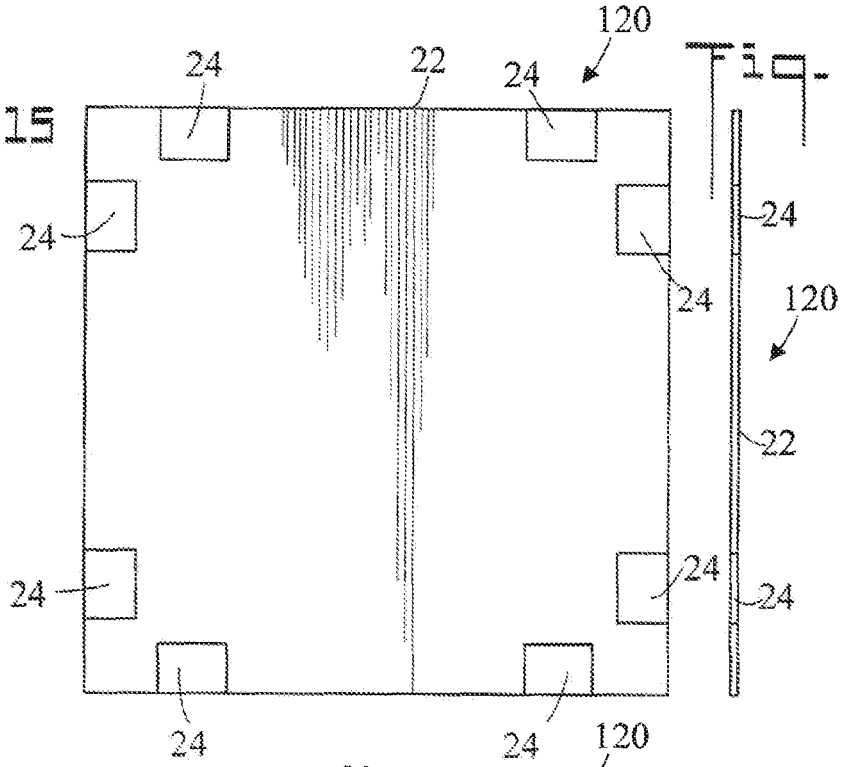
Fig. 18
Fig. 16
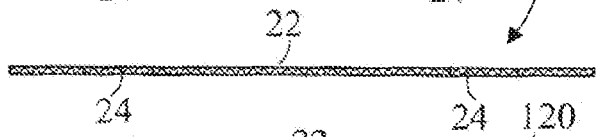
Fig. 17
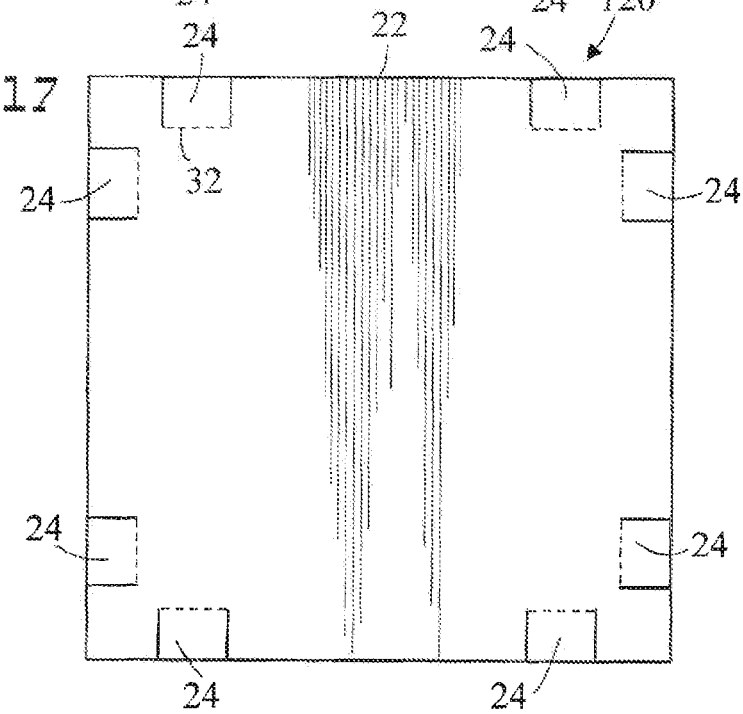

Fig. 23
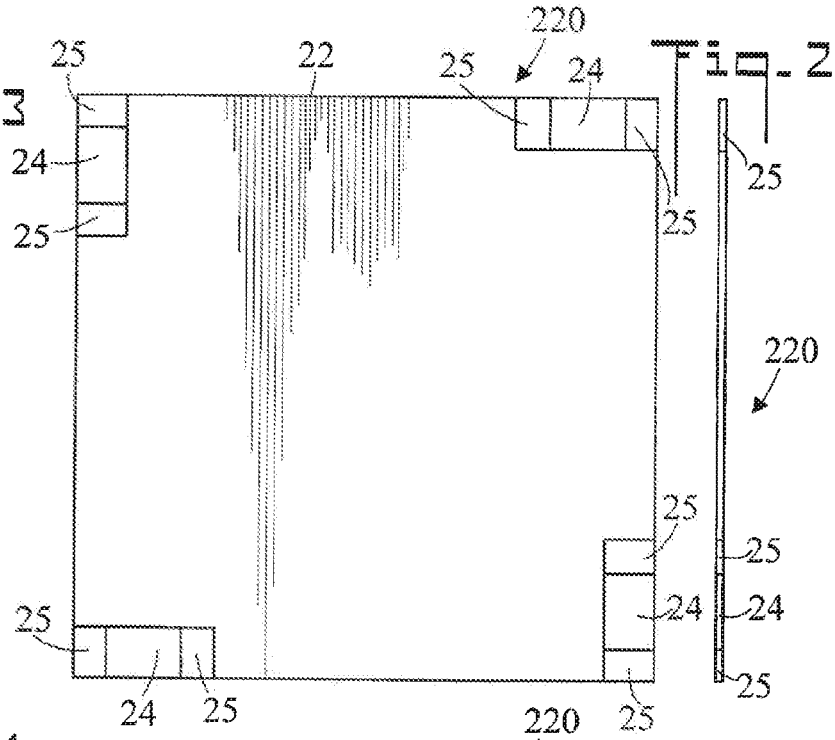
Fig. 26
Fig. 24
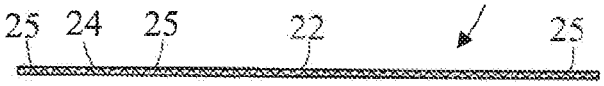
Fig. 25
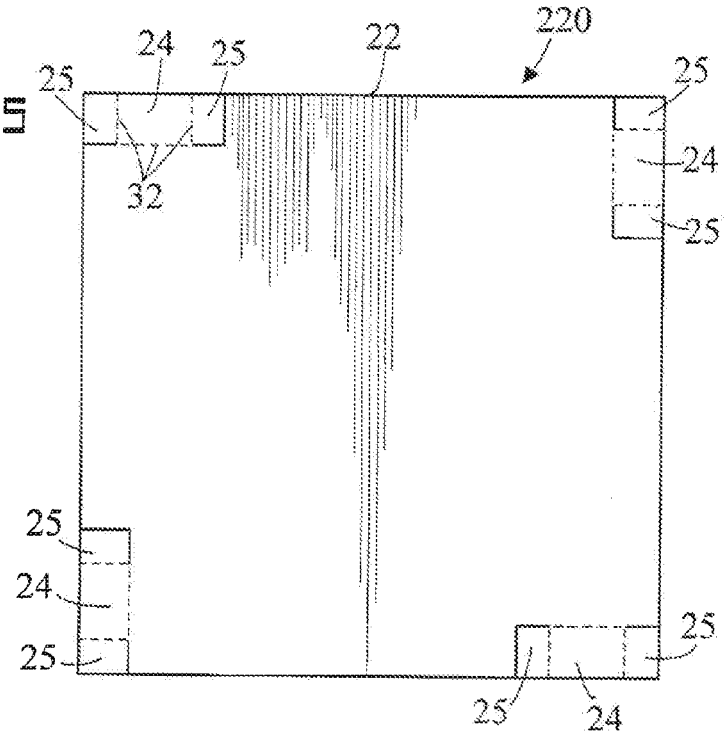

DEVICE FOR SUPPORTING A SECOND PIZZA IN A PIZZA BOX AND METHOD OF USE

TECHNICAL FIELD

The present invention pertains generally to pizza packaging, and more particularly to a device which allows two pizzas to be placed in one pizza box.

BACKGROUND OF THE INVENTION

Pizzas are packaged in boxes for delivery and take-out. Typically one circular pizza is placed within in a rectangular box and a lid is closed to protect the pizza and contain the pizza's heat. A pizza support (small pedestal) can be placed on the pizza to prevent the box lid from contacting the pizza.

SUMMARY OF THE INVENTION

The present invention is directed to a device for supporting a second pizza in a pizza box. The device permits two pizzas to be transported within the same pizza box, and provides the following advantages:

- saves the expense of a second pizza box
- the combined heat from two pizzas keeps both pizzas warmer for a longer period of time
- a delivery person carries less boxes
- less boxes benefits the environment
- takes up half the space when serving the pizzas at the table In accordance with an embodiment, a device is disclosed for supporting a second pizza in a rectangular pizza box which contains a first pizza, the pizza box having four corner zones. The device includes, a rectangular platform which is shaped and dimensioned to be received by the pizza box. The platform has at least four tabs, the are tabs selectively positionable to a support position which is substantially perpendicular to the platform. The tabs are located on the platform so that when the tabs are placed in the support position and the platform is placed inside the pizza box, at least one tab will rest upon each corner zone.

In accordance with another embodiment, the platform is positionable in the pizza box so that the platform rests upon the tabs and resides above the first pizza.

In accordance with another embodiment, the tabs are oriented so that when the tabs are placed in the support position, adjacent tabs are perpendicular to one another.

In accordance with another embodiment, the platform is fabricated from corrugated fiberboard which includes a first layer, a second layer, and a corrugated medium disposed therebetween. Each tab has a hinge which is formed by cutting through the first layer and the corrugated medium but not through the second layer.

In accordance with another embodiment, when the tabs are placed in the support position open spaces are created in the platform. The open spaces (1) permit convectional heat to pass between the first pizza and the second pizza, and (2) providing a finger hold for removing the platform from the pizza box.

In accordance with another embodiment, a half height pizza support which is positionable on the first pizza, and which supports the platform.

In accordance with another embodiment, the platform has eight tabs wherein when the tabs are placed in the support position and said platform is placed inside the pizza box, two said tabs will rest upon each corner zone.

In accordance with another embodiment, the tabs are oriented so that When the tabs are placed in the support position, two tabs in each corner zone are perpendicular to one another.

In accordance with another embodiment, when the tabs are placed in the support position, open spaces are created in the platform. The open spaces (1) permit convectional heat to pass between the first pizza and the second pizza, and (2) each two tabs in each corner zone provide adjacent open spaces for a finger hold and a thumb hold with a web of platform between for removing the platform from the pizza box by pinching the web between a finger and a thumb.

In accordance with another embodiment, each tab includes two side tabs which are positionable perpendicular to the tab to form a U-shaped-support upon which the platform can rest.

Other embodiments, in addition to the embodiments enumerated above, will become apparent from the following detailed description, taken in conjunction with the accompanying drawings, which illustrate, by way of example, the principles of the device and method of use.

BRIEF DESCRIPTION OF THE DRAWINGS

FIG. 15 is a top plan view of a second embodiment device for supporting a second pizza in the pizza box;

FIG. 16 is a side elevation view of the second embodiment device;

FIG. 17 is a bottom plan view of the second embodiment device;

FIG. 18 is another side elevation view of the second embodiment device;

FIG. 23 is a top plan view of a third embodiment device for supporting a second pizza in the pizza box;

FIG. 24 is a side elevation view of the third embodiment device;

FIG. 25 is a bottom plan view of the third embodiment device;

FIG. 26 is another side elevation view of the third embodiment device;

DETAILED DESCRIPTION OF THE INVENTION

Figure 1:
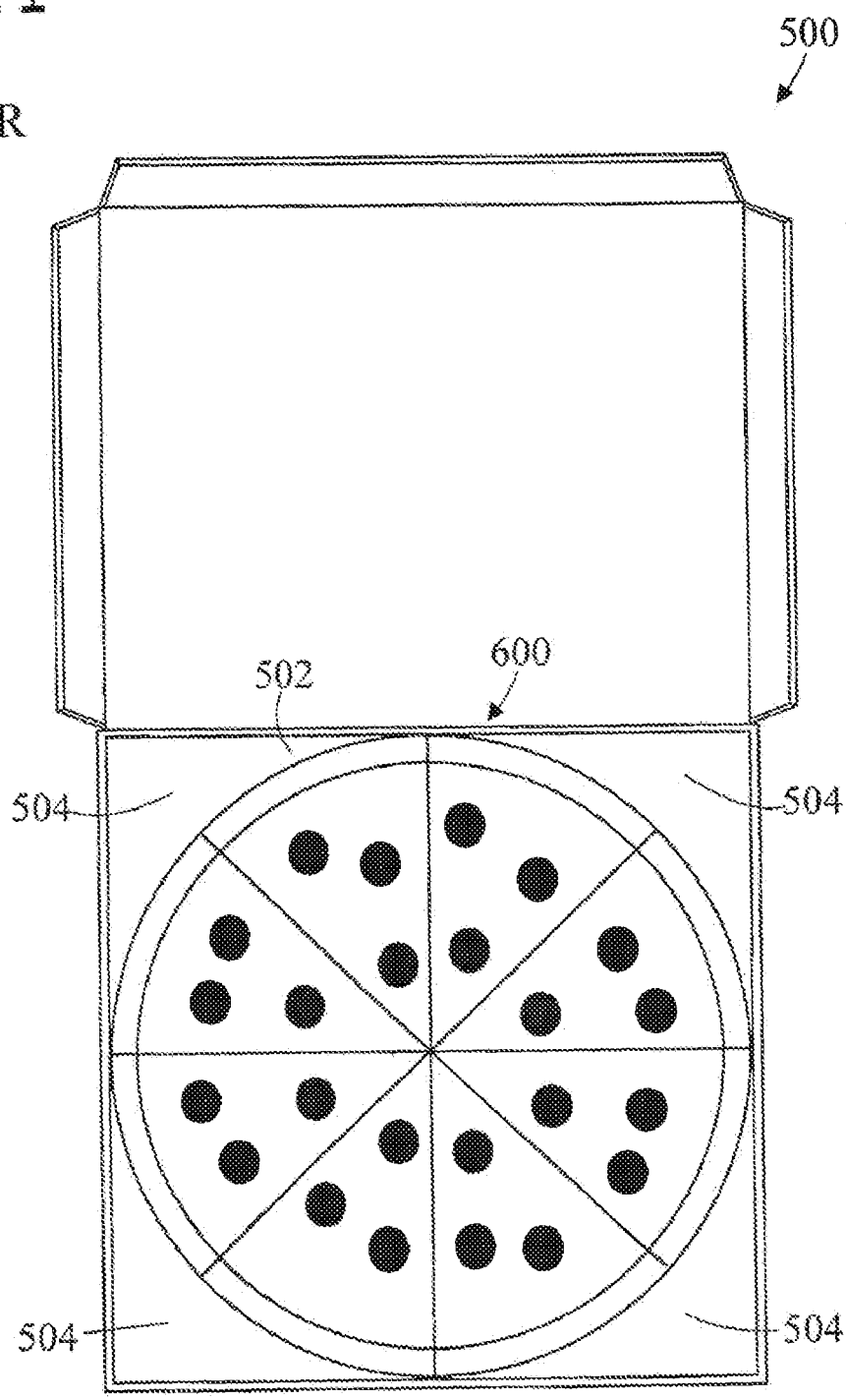
Fig. 1 PRIOR ART
FIG. 1 is a top plan view of a prior art pizza box containing a pizza.

Referring initially to FIG. 1, there is illustrated a top plan view of a prior art pizza box 500 containing a first pizza 600. In the shown embodiment, pizza box 500 is rectangular (such as the shown square) and first pizza 600 is circular. Pizza box 500 has a bottom 502 upon which first pizza 600 rests. Bottom 502 has four corner zones 504. As used herein the term "corner zones" means the four corner areas of bottom 502 which are not occupied by circular first pizza 600.

Now referring to FIGS. 2-7, there are illustrated top plan, side elevation, bottom plan, another side elevation, an enlarged side elevation, and perspective views, respectively, of a device for supporting a second pizza 700 (FIG. 12) in pizza box 500, the device generally designated as 20. Device 20 includes a rectangular planar platform 22 which is shaped and dimensioned to be closely received by pizza box 500. Platform 22 has at least four tabs 24 which are selectively positionable (downward) to a support position which is substantially perpendicular to platform 22 (refer to FIG. 7). That is, tabs 24 are bent approximately 90° from the unbent position shown in FIGS. 2-5. Tabs 24 are oriented so that when tabs 24 are placed in the support position, adjacent tabs 24 are perpendicular to one another (refer to FIG. 7). This alternate direction positioning stabilizes platform 20 in pizza box 500. Tabs 24 are located on platform 22 so that when tabs 24 are placed in the support position and platform 22 is placed inside pizza box 500, at least one tab 24 will rest upon each corner zone 504 (refer to FIGS. 8 and 11). That is, in the support position, tabs 24 act as legs which support platform 22 above first pizza 600 with the four legs each residing on one of the four corner zones 504 (refer to FIGS. 11 and 13)

Figures 2, 3, 4, 5, 6:
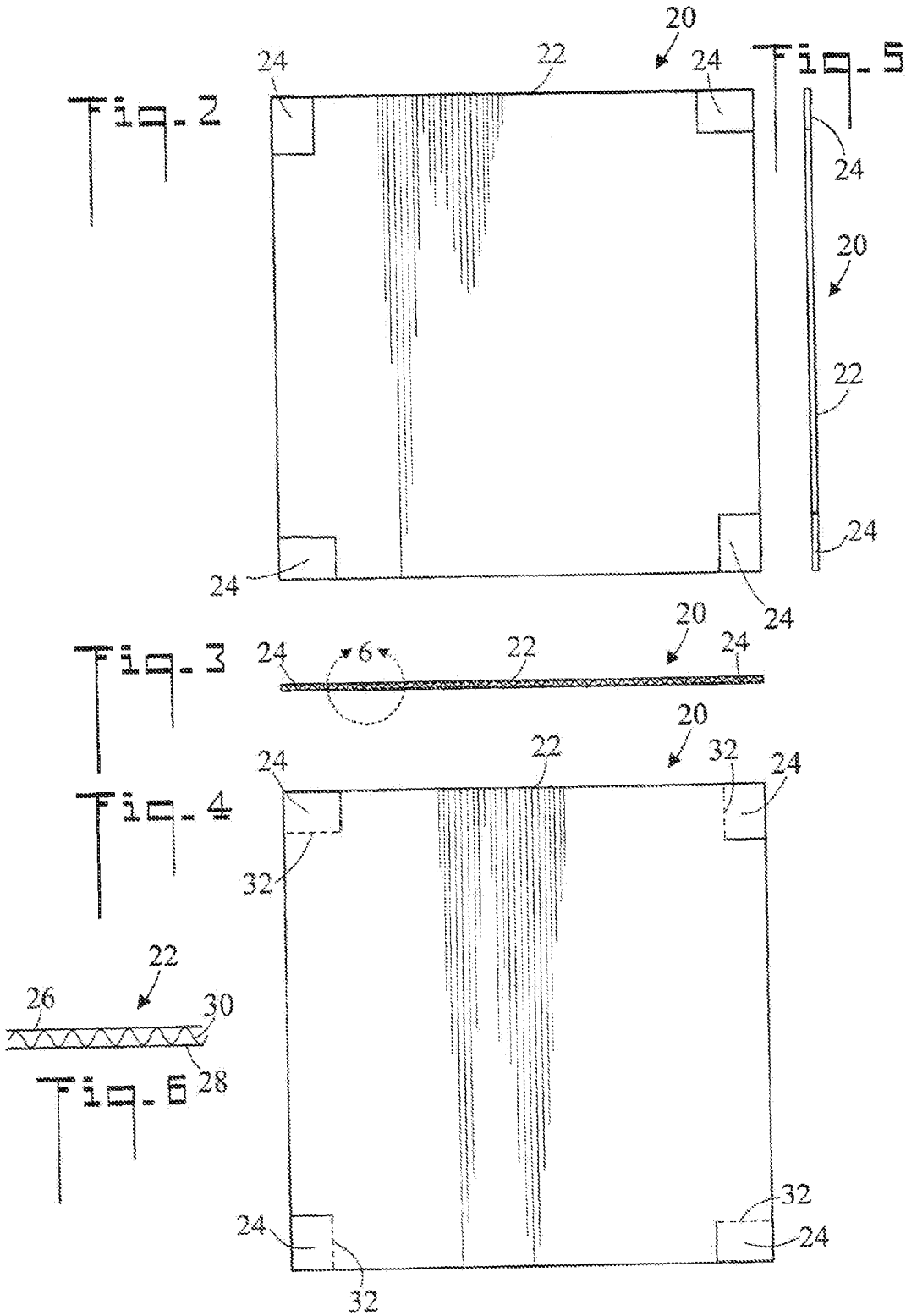
FIG. 2 is a top plan view of a device for supporting a second pizza in the pizza box.
FIG. 3 is a side elevation view of the device.
FIG. 4 is a bottom plan view of the device.
FIG. 5 is another side elevation view of the device.
FIG. 6 is an enlarged view of area 6 of FIG. 3.
Figure 8:
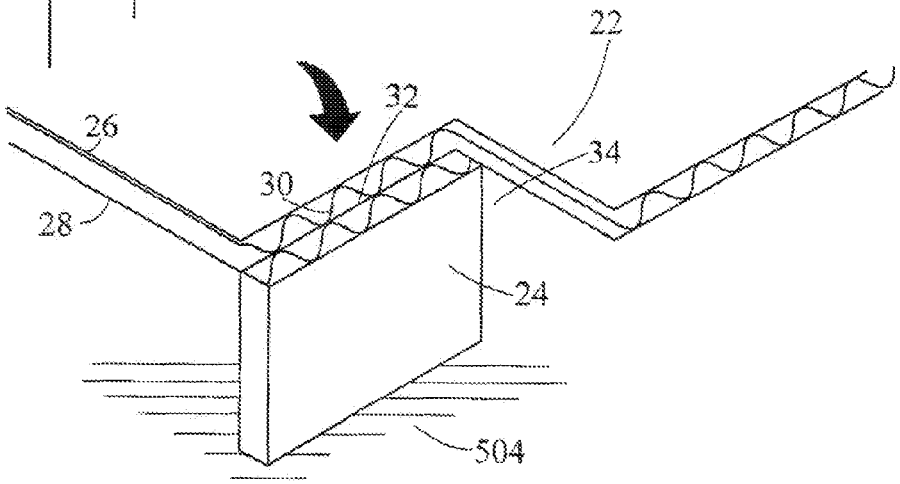
FIG. 8 is an enlarged view of area 8 of FIG. 7.

Referring specifically to FIG. 6, platform 22 is fabricated from corrugated fiberboard which includes a first layer 26, a second layer 28, and a corrugated medium 30 disposed therebetween. Referring now to FIG. 8, each tab 24 has a hinge 32 about which tab 24 rotates (also refer to FIG. 4 which shows hinges 32 as broken lines. Hinge 32 is formed by cutting through first layer 26 and corrugated medium 30 but not through second layer 28. In other words, tab 24 pivots about hinge 32 which is part of second layer 28. It is noted that cutting first layer 26 and corrugated medium 30 reduces the tendency of tabs 24 to return to the their flat unbent position of FIGS. 2-5. It is further noted that in FIG. 8, tab 24 is shown resting upon a corner zone 504 (refer to FIG. 1). FIGS. 2 and 4 show the cut lines which form tabs 24. FIG. 4 also shows hinge 32 as a broken line.

Figure 7:
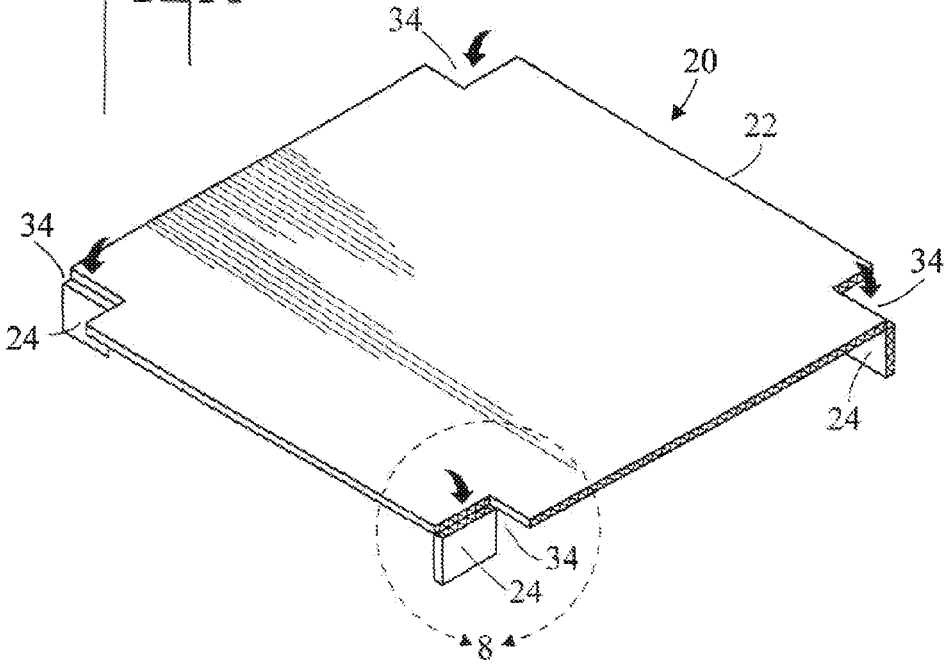
FIG. 7 is a perspective view of the device.

FIG. 8 is an enlarged view of area 8 of FIG. 7, showing platform 22, tabs 24, first layer 26, second layer 28, corrugated medium 30, hinge 32, open spaces 34, and corner zone 504.

Figure 9:
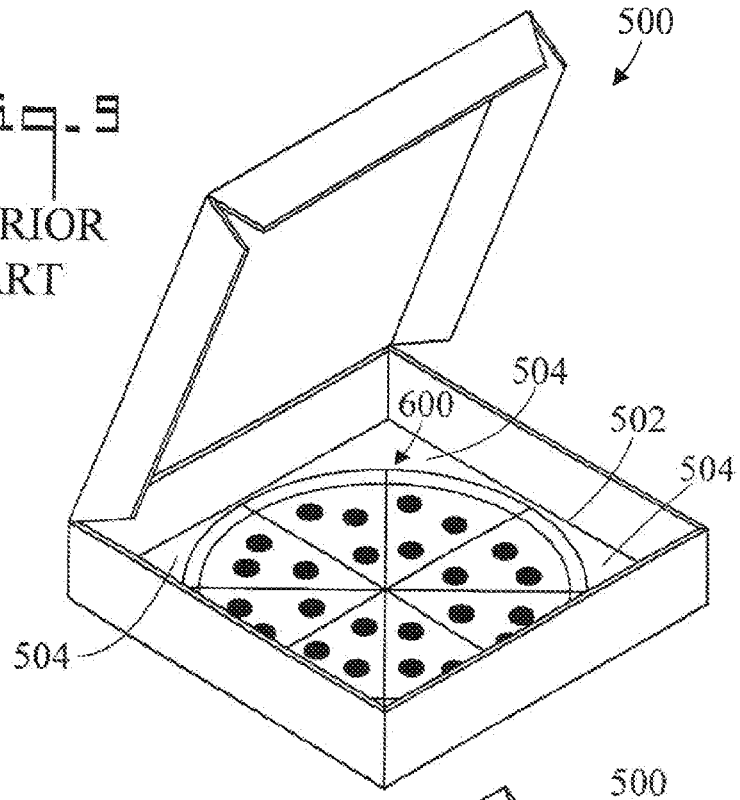
Fig. 9 PRIOR ART
FIG. 9 is a reduced perspective view of a prior art pizza in a pizza box.
Figure 10:
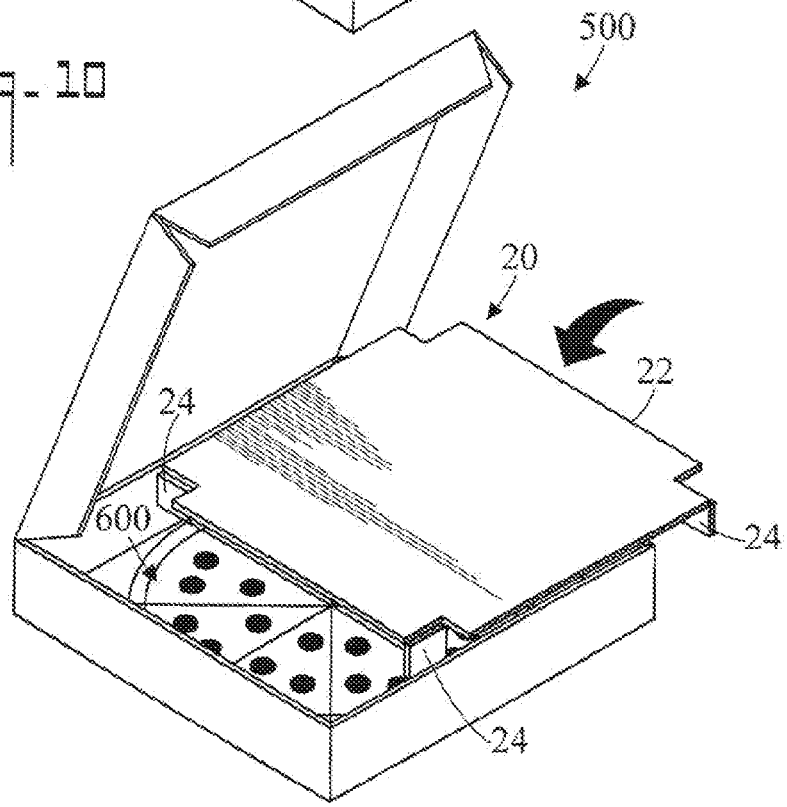
FIG. 10 is a reduced perspective view of the device being inserted into the pizza box of FIG. 9.
Figure 11:
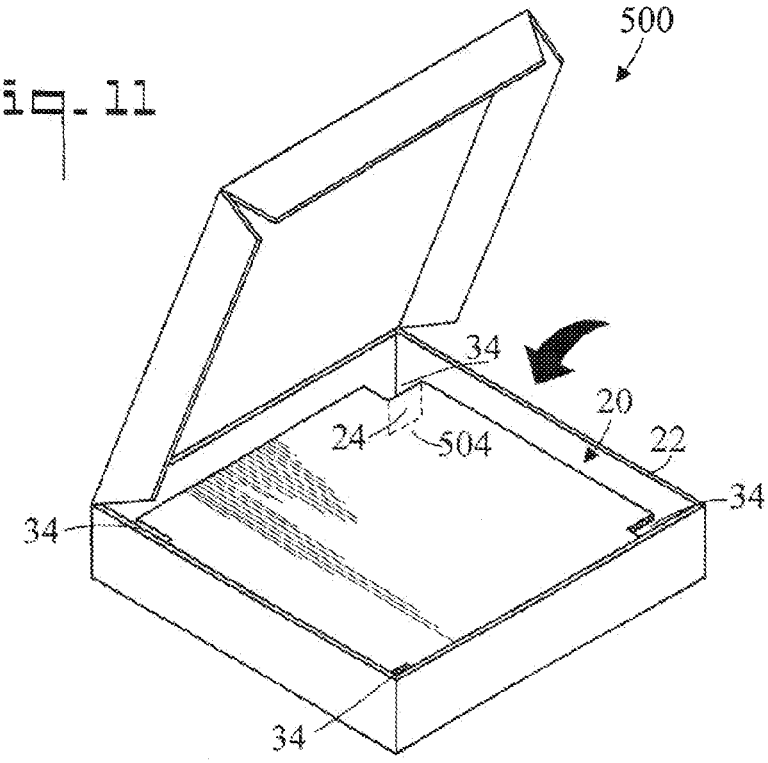
FIG. 11 is a reduced perspective view of the device fully inserted into the pizza box.
Figure 12:
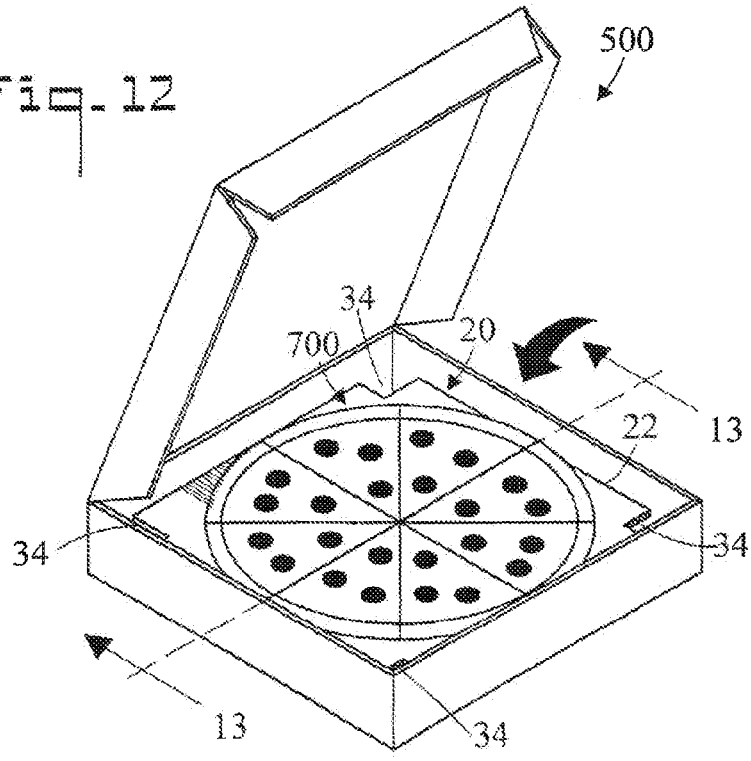
FIG. 12 is a reduced perspective view of a second pizza placed on the device.

FIGS. 9-12 show the sequence of placing device 20 into pizza box 500. In FIG. 9, a prior art pizza box 500 having a first pizza 600 is depicted. It is noted that first pizza 600 does not cover corner zones 504. FIG. 10 shows platform 22 with tabs 24 in the support position being inserted into pizza box 500 on top of first pizza 600. FIG. 11 shows platform 22 fully inserted into pizza box 500 with tabs 24 residing on corner zones 504 (refer to FIG. 8). Platform 22 is positionable in pizza box 500 so that platform 22 rests upon tabs 24 and resides above first pizza 600. It is noted that when tabs 24 are placed in the support position, open spaces 34 are created in platform 22 (also refer to FIG. 7). FIG. 12 shows a second pizza 700 placed on platform 22, thereby permitting two pizza to be carried in pizza box 500. Open spaces 34 (1) permit convectional heat to pass between first pizza 600 and second pizza 700, and (2) provide a finger 800 hold for removing platform 22 from pizza box 500 (refer to FIG. 32). It may be appreciated that pizza box 500 could be made deeper to accommodate the two pizzas.

Figure 13:
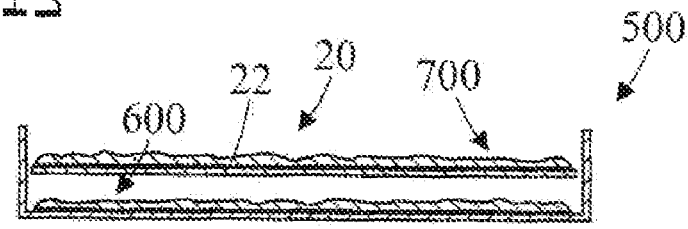
FIG. 13 is a cross sectional view along the line 13-13 of FIG. 12.

FIG. 13 is a cross sectional view along the line 13-13 of FIG. 12, showing pizza box 500, first pizza 600, device 20 including platform 22, and second pizza 700 disposed on platform 22.

Figure 14:
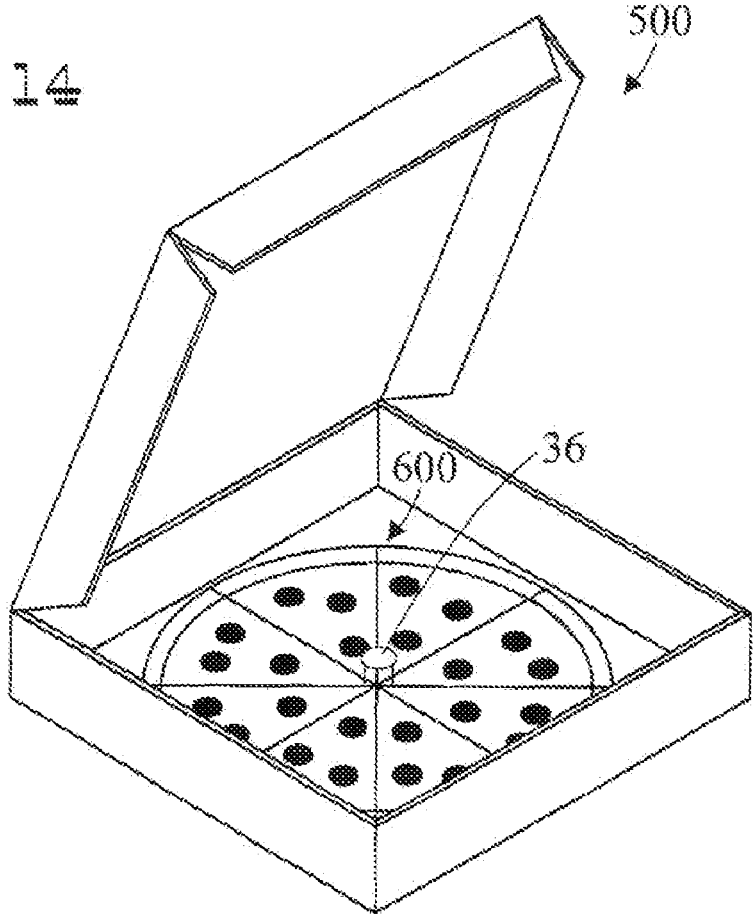
FIG. 14 is a reduced perspective view of a half-height pizza support placed on the pizza of FIG. 9.

FIG. 14 is a reduced perspective view of a half-height pizza support 36 placed on first pizza 600. Half height pizza support 36 is positionable on first pizza 600, and serves to support the center portion of platform 22. The height of half height pizza support 36 is approximately one-half of the height of a conventional pizza support since two pizzas are placed in pizza box 500. It is noted that a second half height pizza support 36 could also be placed on second pizza 700 to prevent the top of pizza box 500 from contacting second pizza 700.

FIGS. 15-19 are top plan, side elevation, bottom plan, another side elevation, and perspective views, respectively, of a second embodiment device 120 for supporting a second pizza 700 in pizza box 500. Second embodiment 120 is similar to first embodiment 20. However, in second embodiment 120, platform 22 has eight tabs 24. When tabs 24 are placed in the support position and platform 22 is placed inside pizza box 500, two tabs 24 will rest upon each corner zone 504 (refer also to FIGS. 20-22). Tabs 24 are oriented so that when tabs 24 are placed in the support position, the two tabs 24 in each corner zone 504 are perpendicular to one another (refer also to FIG. 20). When tabs 24 are placed in the support position, open spaces 34 are created in platform 22. Open spaces 34 (1) permit convectional heat to pass between first pizza 60 and second pizza 700, and (2) each two tabs 24 in each corner zone 504 provide adjacent open spaces 34 for a finger 800 hold and a thumb 900 hold with a web 23 of platform 22 between for removing platform 22 from pizza box 500 by pinching web 23 between a finger 800 and a thumb 900 (refer to FIGS. 20 and 33).

Figure 19:
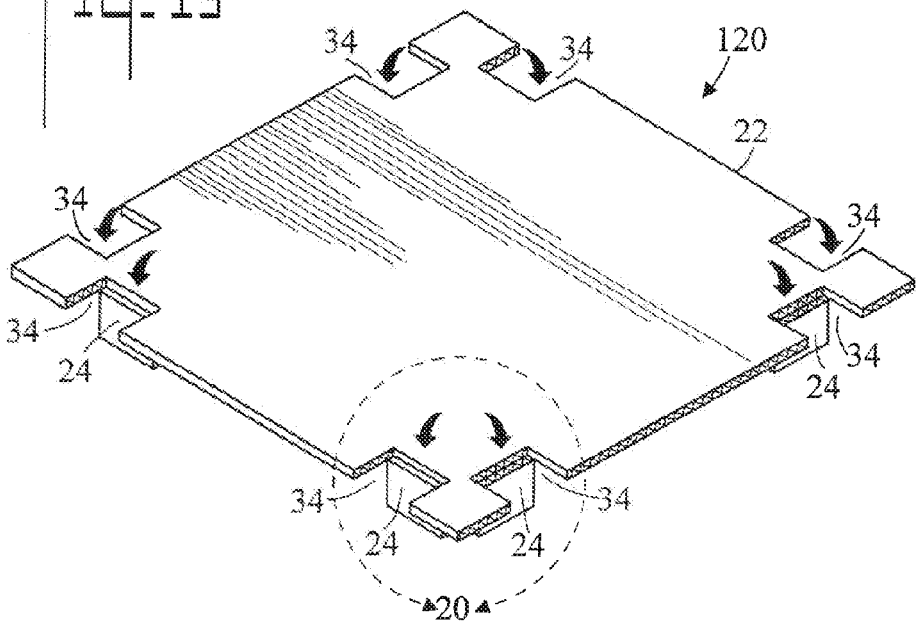
FIG. 19 is a perspective view of the second embodiment device.
Figure 20:
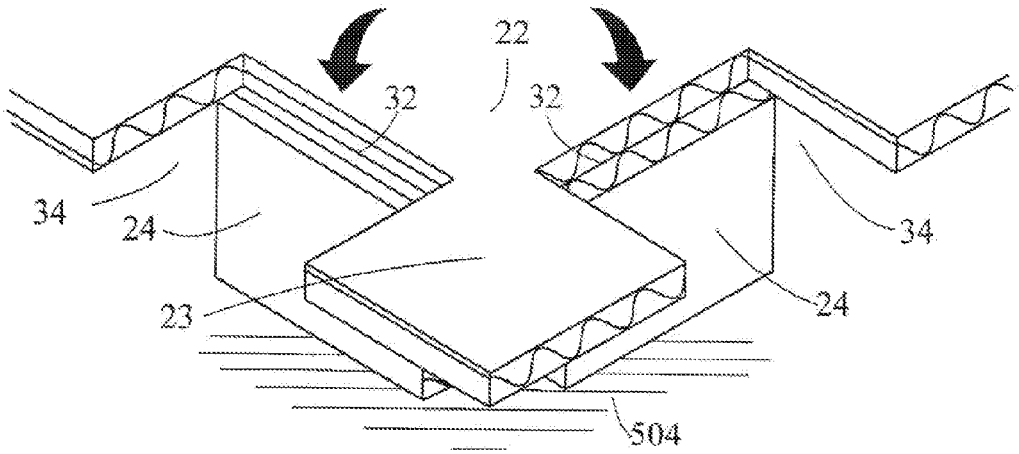
FIG. 20 is an enlarged view of area 20 of FIG. 19.

FIG. 20 is an enlarged view of area 20 of FIG. 19, showing platform 22, tabs 24, web 23, hinges 32, open spaces 34 and corner zone 504.

Figure 21:
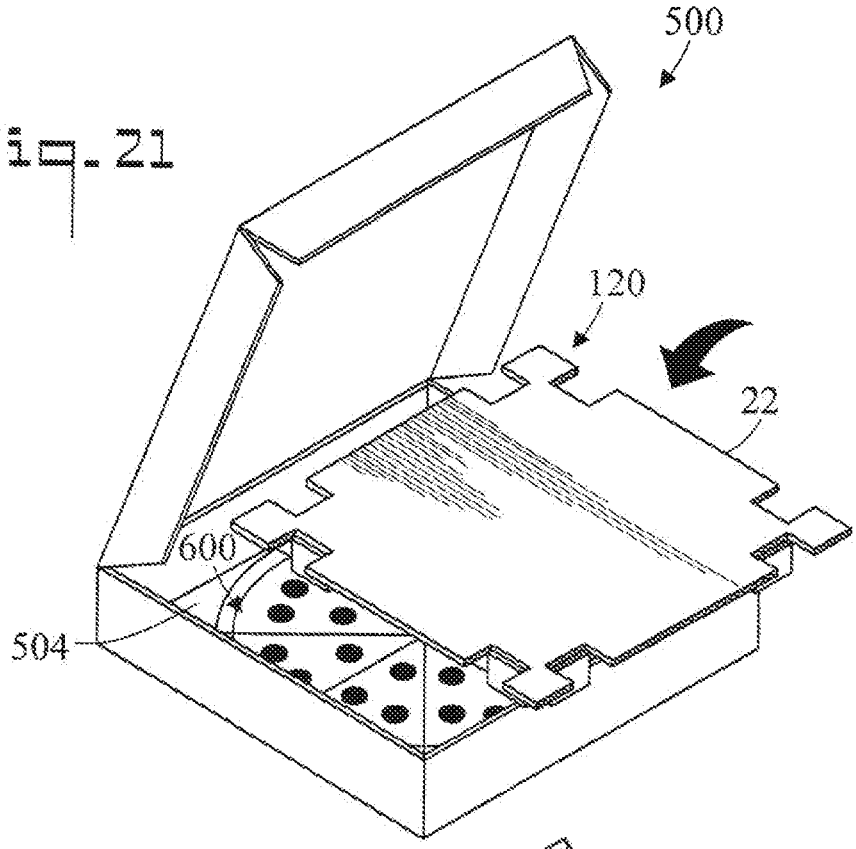
FIG. 21 is a reduced perspective view of the second embodiment device being inserted into the pizza box of FIG. 9.
Figure 22:
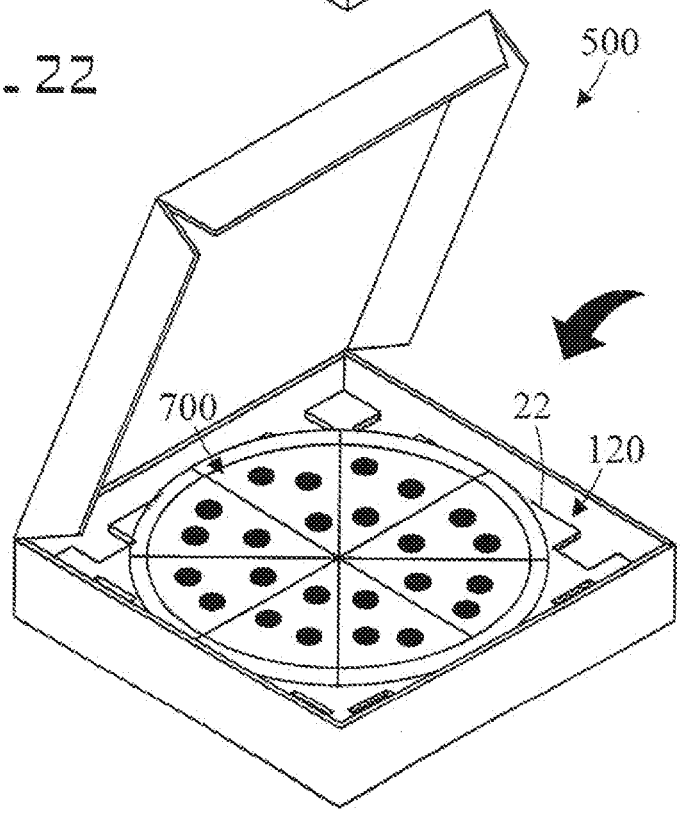
FIG. 22 is a reduced perspective view of the second embodiment device fully inserted into the pizza box of FIG. 9 with a second pizza placed on the device.

FIG. 21 is a reduced perspective view of second embodiment device 120 being inserted into pizza box 500. And, FIG. 22 is a reduced perspective view of second embodiment device 120 fully inserted into pizza box 500 with second pizza 700 placed on platform 22. The insertion process for second embodiment 120 is similar to that of first embodiment 20, except that two tabs 24 rest in each corner zone 504.

FIGS. 23-27 are top plan, side elevation, bottom plan, another side elevation, and perspective views, respectively, of a third embodiment device 220 for supporting a second pizza 700 in pizza box 500. Third embodiment 220 is similar to first embodiment 20, however in third second embodiment 220 each tab 24 includes two side tabs 25 which are positionable perpendicular to tab 24 to form a U-shaped-support upon which platform 22 can rest (also refer to FIGS. 28-29). The U-shaped structure provides increased support stability for platform 22. As such, each tab 24 has three hinges which are shown as broken lines on FIG. 25.

Figure 27:
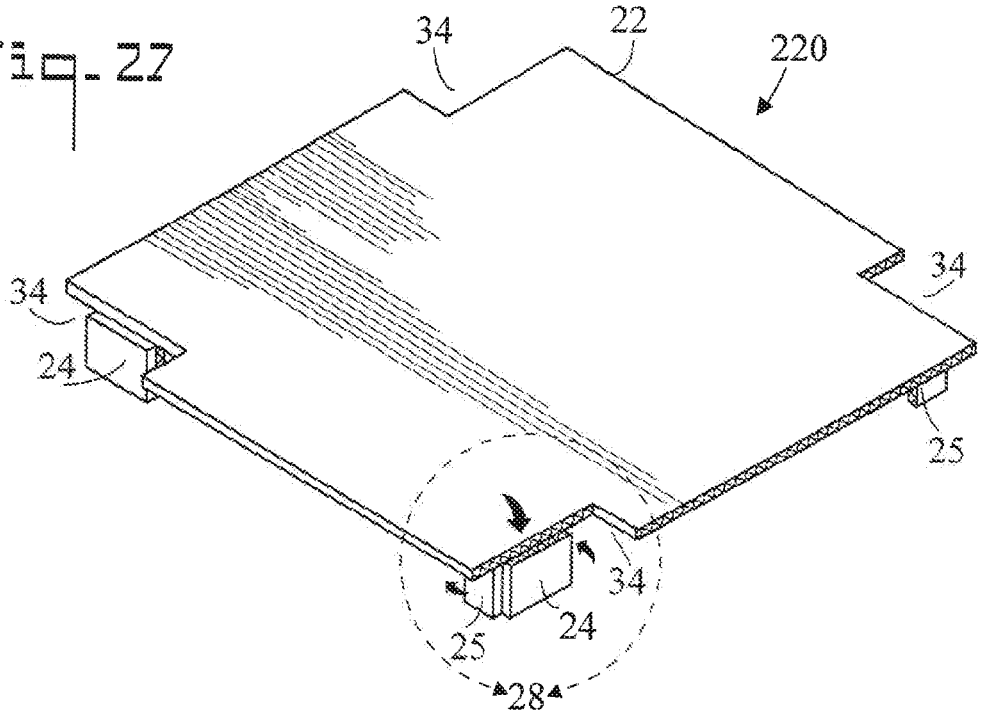
FIG. 27 is a perspective view of the third embodiment device.
Figure 28:
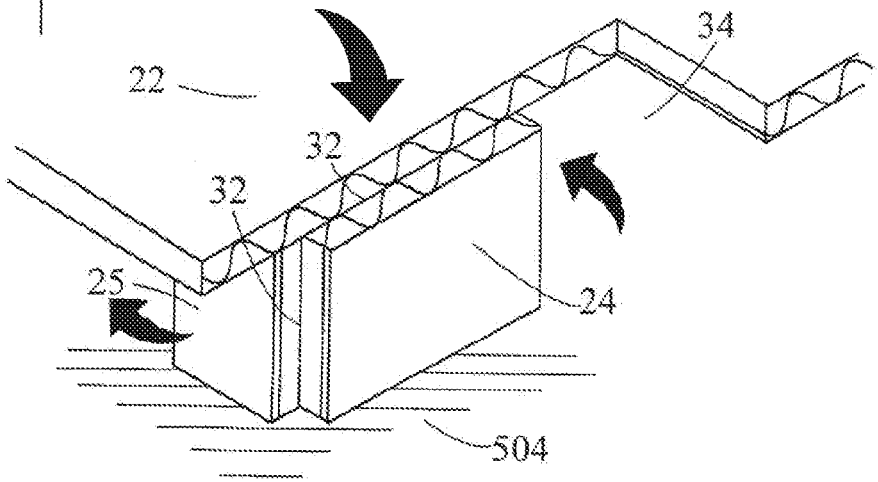
FIG. 28 is an enlarged view of area 28 of FIG. 27.

FIG. 28 is an enlarged view of area 28 of FIG. 27, showing, platform 22 tab 24, side tab 25, hinges 32, open space 34, and corner zone 504.

Figure 29:
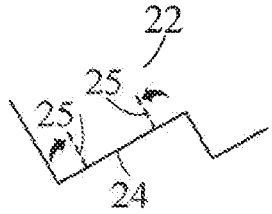
FIG. 29 is a fragmented top plan view of a corner of the third embodiment.

FIG. 29 is a fragmented top plan view of a corner of third embodiment 220 showing platform 22, tab 24, and side tabs 25 folded under platform 22 as represented by the broken lines.

Figure 30:
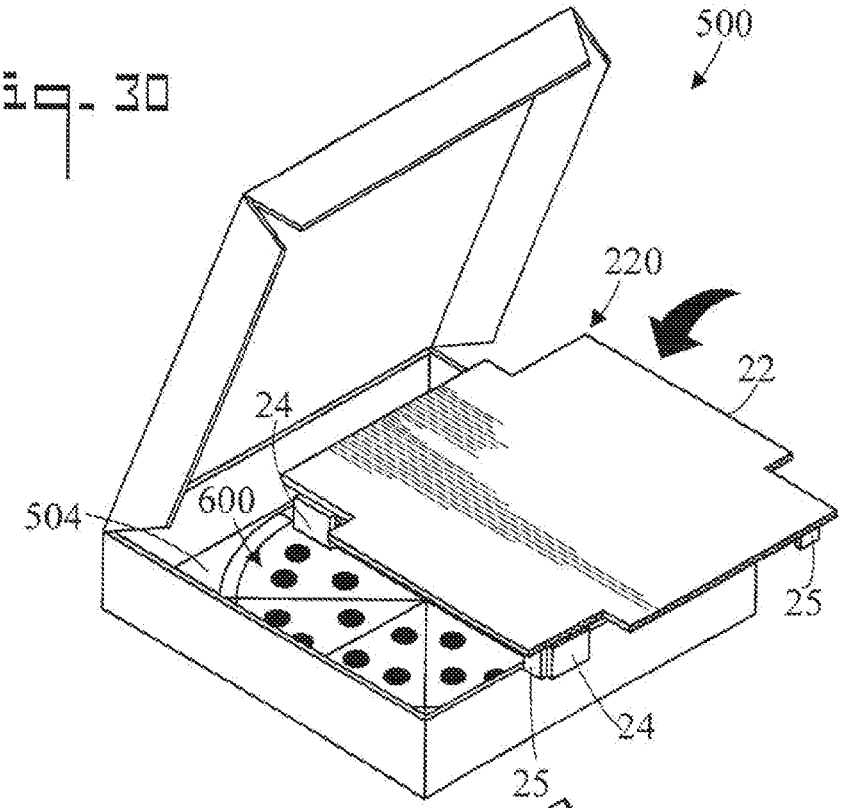
FIG. 30 is a reduced perspective view of the third embodiment device being inserted into the pizza box of FIG. 9.

FIG. 30 is a reduced perspective view of third embodiment 220 device being inserted into pizza box 500. As with embodiments 20 and 120, tabs 24 are placed in corner zones 504. However, in embodiment 220, each tab 24 includes two side tabs 25.

Figure 31:
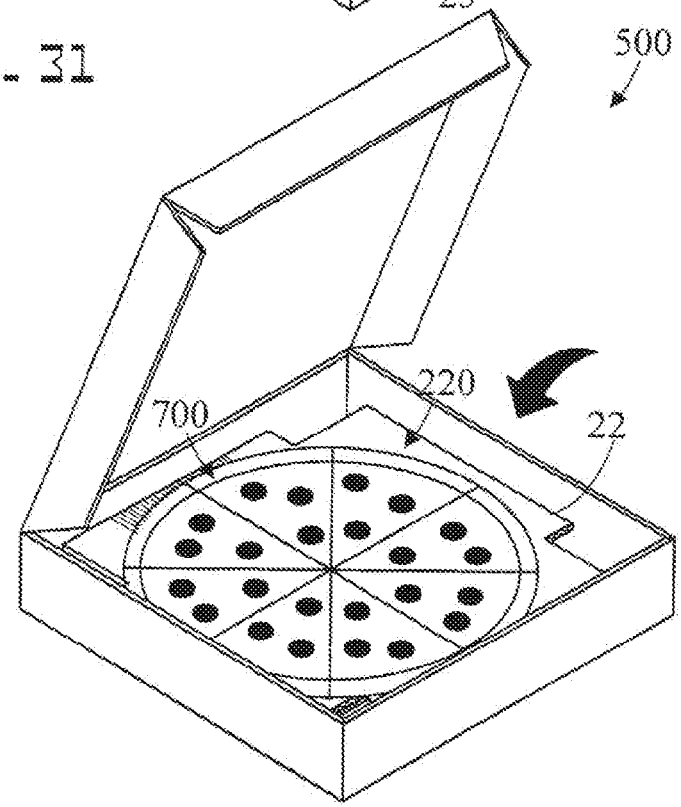
FIG. 31 is a reduced perspective view of the third embodiment device fully inserted into the pizza box of FIG. 9 with a second pizza placed on the device.

FIG. 31 is a reduced perspective view of third embodiment device 220 fully inserted into pizza box 500 with a second pizza 700 placed on platform 22.

Figure 32:
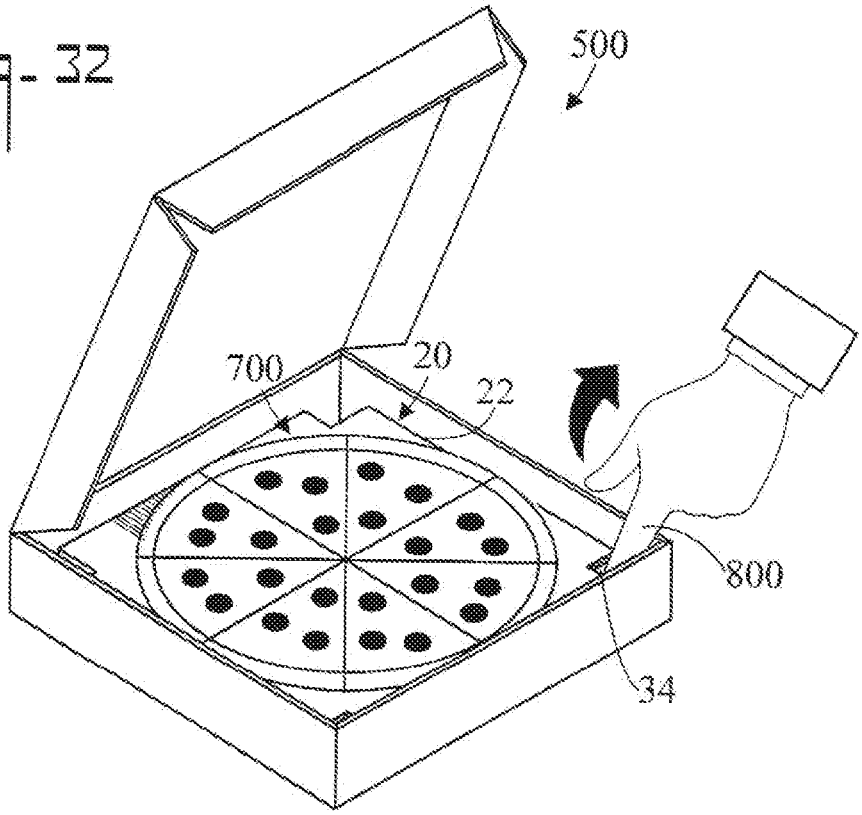
FIG. 32 is a reduced perspective view of the first embodiment device with a finger being used to remove the device from the pizza box.

FIG. 32 is a reduced perspective view of first embodiment 20 with a finger 800 being used to remove platform 22 from pizza box 500. Finger 800 is inserted in open space 34 and platform 22 is lifted out of pizza box 500. Another finger from another hand can be inserted into the space 34 across platform 22. Together, the two fingers can easily lift platform 22 and pizza 700 from pizza box 500.

Figure 33:
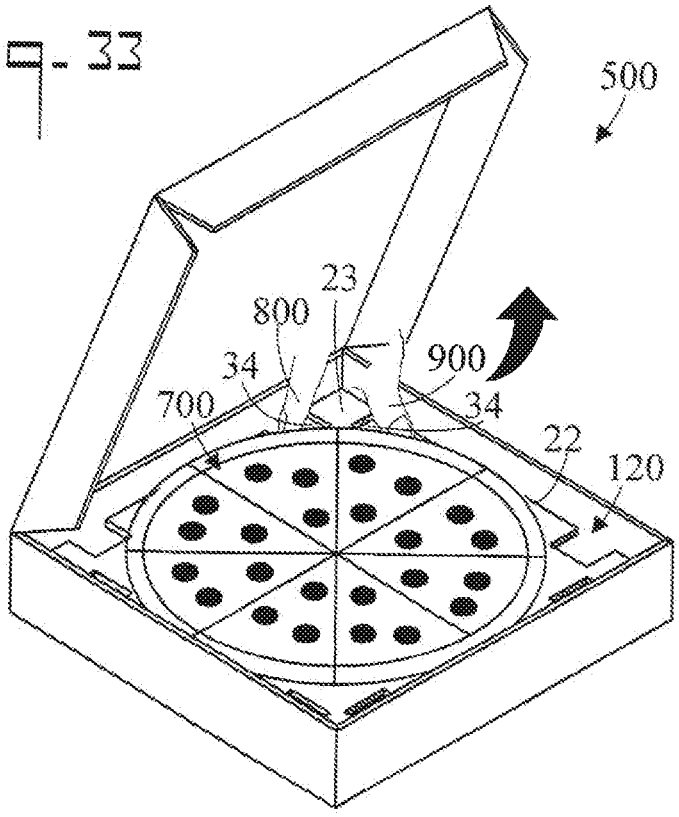
FIG. 33 is a reduced perspective view of the second embodiment device with a finger and thumb used to remove the device from the pizza box; and, FIG. 34 is a reduce perspective view of the first embodiment device resting upon a support surface.

FIG. 33 is a reduced perspective view of second embodiment 120 with a finger 800 and thumb 900 used to remove platform 22 from pizza box 500. Each two tabs 24 in each corner zone 504 (refer to FIG. 1) provide adjacent open spaces 34 for a finger 800 hold and a thumb 900 hold with a web 23 of platform 22 between. The finger and thumb pinch the web 23 between them to lift platform 22 out of pizza box 500. Another finger and thumb from another hand can be inserted into the open spaces 34 across platform 22 to pinch the web 23 there. Together the two hands can easily lift platform 22 and pizza 700 from pizza box 500.

Figure 34:
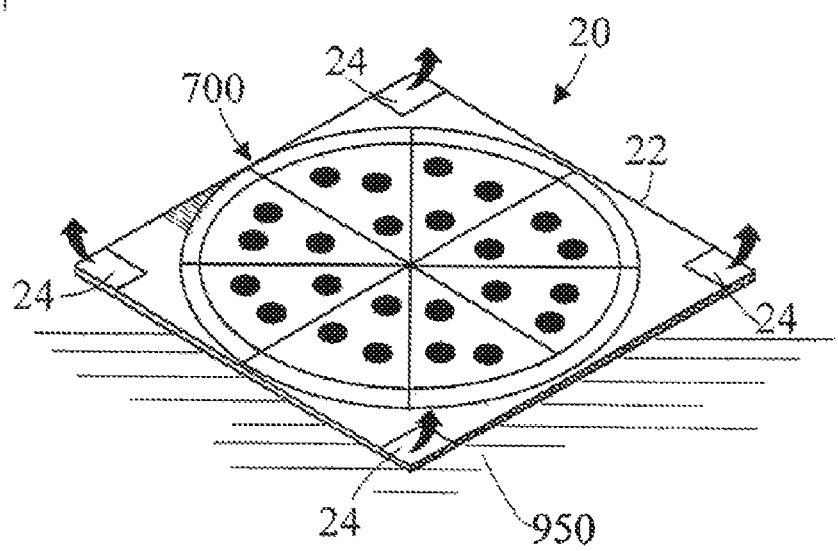

FIG. 34 is a reduced perspective view of first embodiment 20 resting upon a support surface 950 (such as a table). A significant advantage of tabs 24 is that they can be easily collapsed once platform 22 is removed from pizza box 500. This causes platform 22 to lie flat in a stable state on support surface 950, which facilitates pizza slice removal and cutting as necessary.

In terms of use, a method for packaging two pizzas includes: (refer to FIGS. 1-34)

(a) providing a rectangular pizza box 500 having four corner zones 504;

(b) providing a first pizza 600;

(c) providing a second pizza 700;

(d) providing a device 20 for supporting second pizza 700, device 20 including a rectangular platform 22 which is shaped and dimensioned to be received by pizza box 500, platform 22 having at least four tabs 24 which are selectively positionable to a support position which is substantially perpendicular to platform 22, and tabs 24 located on platform 22 so that when tabs 24 are placed in the support position and platform 22 is placed inside pizza box 550, at least one tab will rest upon each corner zone 504;

(e) placing first pizza 600 in pizza box 500;

(f) placing tabs 24 in the support position;

(g) placing platform 22 in pizza box 500 so that each tab 24 rests upon a corner zone 504; and, (h) placing second pizza 700 on platform 22.

The method further including:

providing a support surface 950;

after step (h), removing platform 22 and second pizza 700 from pizza box 500, and placing platform 22 on support surface 950 wherein tabs 24 collapse so that platform 22 lies flat upon support surface 22.

The method further including:

in step (f), when tabs 24 are placed in the support position, open spaces 34 are created in platform 34; and, open spaces 34 providing finger 800 holds for removing platform 22 and second pizza 700 from pizza box 500.

The method further including:

in step (g), platform 22 is positionable in pizza box 500 so that platform 22 rests upon tabs 24 and resides above first pizza 600.

The method further including:

in step (d), tabs 24 oriented so that when tabs 24 are placed in the support position in step (f), adjacent tabs 24 are perpendicular to one another.

The method further including:

in step (d), platform 22 fabricated from corrugated fiberboard which includes a first layer 26, a second layer 28, and a corrugated medium 30 disposed therebetween. Each tab 24 having a hinge 32 which is formed by cutting through first layer 26 and corrugated medium 30 but not through second layer 28; and, in step (f), using hinge 32 to place tab 24 in the support position.

The method further including:

in step (f), when tabs 24 are placed in the support position, open spaces 34 being created in platform 22; after step (h), open spaces 34 (1) permitting convectional heat to pass between first pizza 600 and second pizza 700, and (2) providing finger 800 holds for removing platform 22 from pizza box 500; and, after step (h), inserting a finger 800 in one of the open spaces 34 and another finger 800 in another of the open spaces 34 and lifting platform 22 and second pizza 700 out of pizza box 500.

The method further including:

in step (d), device 20 further including a half height pizza support 36 which is positionable on first pizza 600, and which supports platform 22; and, prior to step (g), placing half height pizza support 36 on first pizza 600.

The method further including:

in step (d), platform 22 having eight tabs 24 wherein when tabs 24 are placed in the support position and platform 22 is placed inside pizza box 500, two tabs 24 will rest upon each corner zone 504; and, in step (g), two tabs 24 resting upon each corner zone 504.

The method further including:

in step (d), tabs 24 oriented so that when tabs 24 are placed in the support position of step (f), the two tabs 24 in each corner zone 504 are perpendicular to one another.

The method further including:

in step (d), each two tabs 24 in each corner zone 504 providing adjacent open spaces 34 for a finger 800 hold and a thumb 900 hold with a web 23 of platform 22 between for removing platform 22 from pizza box 500 by pinching web 23 between a finger 800 and a thumb 900; and, after step (h), inserting a finger 800 in one of the open spaces 34 and a thumb 900 in an adjacent open space 34 and pinching web 23 between finger 800 and thumb 900, inserting another finger 800 in another open space 34 and another thumb 900 in an adjacent open space 34 and pinching web 23 between open spaces 34 and lifting platform 22 and second pizza 700 out of pizza box 500.

The method further including:

in step (d), each tab 34 including two side tabs 25 which are positionable perpendicular to tab 24 to form a U-shaped-support upon which platform 22 can rest; and, in step (f), folding side tabs 25 to form the U-shaped support.

The embodiments of the device and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the device and method should be construed as limiting the invention to a particular embodiment or combination of embodiments. The scope of the invention is best defined by the appended claims.

I claim:

1. A device for supporting a second pizza in a rectangular pizza box which contains a first pizza, the pizza box having four corner zones, the device comprising:

a rectangular platform which is shaped and dimensioned to be received by the pizza box;

said platform having at least four tabs, said tabs selectively positionable to a support position which is substantially perpendicular to said platform;

said tabs located on said platform so that when said tabs are placed in said support position and said platform is placed inside the pizza box, at least one said tab will rest upon each corner zone;

said platform fabricated from corrugated fiberboard which includes a first layer, a second layer, and a corrugated medium disposed therebetween;

each said tab having a hinge, said hinge formed by a cutting through said first layer and said corrugated medium but not through said second layer; and, so that when said tab is placed in said support position said cut corrugated medium is exposed.

2. A device for supporting a second pizza in a rectangular pizza box which contains a first pizza, the pizza box having four corner zones, the device comprising:

a rectangular platform which is shaped and dimensioned to be received by the pizza box;

said platform having at least four tabs, said tabs selectively positionable to a support position which is substantially perpendicular to said platform;

said tabs located on said platform so that when said tabs are placed in said support position and said platform is placed inside the pizza box, at least one said tab will rest upon each corner zone; and, each said tab including a central portion and two side tabs which are positionable perpendicular to said central portion to form a U-shaped-support upon which said platform can rest.

3. A device for supporting a second pizza in a rectangular pizza box which contains a first pizza, the pizza box having four corner zones, the device comprising:

a rectangular platform which is shaped and dimensioned to be received by the pizza box;

said platform having at least four tabs, said tabs selectively positionable to a support position which is substantially perpendicular to said platform;

said tabs located on said platform so that when said tabs are placed in said support position and said platform is placed inside the pizza box, at least one said tab will rest upon each corner zone;

said platform positionable in the pizza box so that said platform rests upon said tabs and resides above the first pizza;

said tabs oriented so that when said tabs are placed in said support position, adjacent tabs are perpendicular to one another;

said platform fabricated from corrugated fiberboard which includes a first layer, a second layer, and a corrugated medium disposed therebetween;

each said tab having a separate and dedicated hinge different from said hinge of any other said tab, said hinge formed by cutting through said first layer and said corrugated medium but not through said second layer;

when said tabs are placed in said support position, open spaces being created in said platform; and, said open spaces (1) permitting convectional heat to pass between said first pizza and said second pizza, and (2) providing a finger hold for removing said platform from said pizza box.

4. A device for supporting a second pizza in a rectangular pizza box which contains a first pizza, the pizza box having four corner zones, the device comprising:

a rectangular platform which is shaped and dimensioned to be received by the pizza box;

said platform having at least four tabs, said tabs selectively positionable to a support position which is substantially perpendicular to said platform;

said tabs located on said platform so that when said tabs are placed in said support position and said platform is placed inside the pizza box, at least one said tab will rest upon each corner zone;

said platform positionable in the pizza box so that said platform rests upon said tabs and resides above the first pizza;

said platform having eight tabs wherein when said tabs are placed in said support position and said platform is placed inside the pizza box, two said tabs will rest upon each corner zone;

said tabs oriented so that when said tabs are placed in said support position, said two tabs in each corner zone are perpendicular to one another;

said platform fabricated from corrugated fiberboard which includes a first layer, a second layer, and a corrugated medium disposed therebetween;

each said tab having a separate and dedicated hinge different from said hinge of any other said tab, said hinge formed by cutting through said first layer and said corrugated medium but not through said second layer;

when said tabs are placed in said support position, open spaces being created in said platform; and, said open spaces (1) permitting convectional heat to pass between said first pizza and said second pizza, and (2) each said two tabs in each corner zone providing adjacent open spaces for a finger hold and a thumb hold with a web of platform between for removing said platform from said pizza box by pinching said web between a finger and a thumb.

5. A device for supporting a second pizza in a rectangular pizza box which contains a first pizza, the pizza box having four corner zones, the device comprising:

a rectangular platform which is shaped and dimensioned to be received by the pizza box;

said platform having at least four tabs, said tabs selectively positionable to a support position which is substantially perpendicular to said platform;

said tabs located on said platform so that when said tabs are placed in said support position and said platform is placed inside the pizza box, at least one said tab will rest upon each corner zone;

said platform positionable in the pizza box so that said platform rests upon said tabs and resides above the first pizza;

each said tab including two side tabs which are positionable perpendicular to said tab to form a U-shaped-support upon which said platform can rest;

said platform fabricated from corrugated fiberboard which includes a first layer, a second layer, and a corrugated medium disposed therebetween;

each said tab having a hinge, said hinge formed by cutting through said first layer and said corrugated medium but not through said second layer;

when said tabs are placed in said support position open spaces being created in said platform; and, said open spaces (1) permitting convectional heat to pass between said first pizza and said second pizza, and (2) providing a finger hold for removing said platform from said pizza box.

6. Method for packaging two pizzas, comprising:

(a) providing a rectangular pizza box having four corner zones;

(b) providing a first pizza;

(c) providing a second pizza;

(d) providing a device for supporting said second pizza, said device including a rectangular platform which is shaped and dimensioned to be received by said pizza box, said platform having at least four tabs, said tabs selectively positionable to a support position which is substantially perpendicular to said platform, and said tabs located on said platform so that when said tabs are placed in said support position and said platform is placed inside the pizza box at least one said tab will rest upon each corner zone;

(e) placing said first pizza in said pizza box;

(f) placing said tabs in said support position;

(g) placing said platform in said pizza box so that each said tab rests upon a corner zone;

(h) placing said second pizza on said platform;

in step (f), when said tabs are placed in said support position, open spaces being created in said platform, and said open spaces providing a finger hold for removing said platform and said second pizza from said pizza box;

providing a support surface; and, after step (h), removing said platform and said second pizza from said pizza box, and placing said platform on said support surface wherein said tabs collapse so that said platform lies flat upon said support surface.

7. Method for packaging two pizzas, comprising:

(a) providing a rectangular pizza box having four corner zones;

(b) providing a first pizza;

(c) providing a second pizza;

(d) providing a device for supporting said second pizza, said device including a rectangular platform which is shaped and dimensioned to be received by said pizza box, said platform having at least four tabs, said tabs selectively positionable to a support position which is substantially perpendicular to said platform, and said tabs located on said platform so that when said tabs are placed in said support position and said platform is placed inside the pizza box at least one said tab will rest upon each corner zone;

(e) placing said first pizza in said pizza box;

(f) placing said tabs in said support position;

(g) placing said platform in said pizza box so that each said tab rests upon a corner zone;

(h) placing said second pizza on said platform;

in step (d), said platform fabricated from corrugated fiberboard which includes a first layer, a second layer, and a corrugated medium disposed therebetween, and each said tab having a hinge, said hinge formed by cutting through said first layer and said corrugated medium but not through said second layer; and, in step (f), using said hinge to place said tab in said support position, wherein said cut corrugated medium is exposed.

8. Method for packaging two pizzas, comprising:

(a) providing a rectangular pizza box having four corner zones;

(b) providing a first pizza;

(c) providing a second pizza;

(d) providing a device for supporting said second pizza, said device including a rectangular platform which is shaped and dimensioned to be received by said pizza box, said platform having at least four tabs, said tabs selectively positionable to a support position which is substantially perpendicular to said platform, and said tabs located on said platform so that when said tabs are placed in said support position and said platform is placed inside the pizza box at least one said tab will rest upon each corner zone;

(e) placing said first pizza in said pizza box;

(f) placing said tabs in said support position;

(g) placing said platform in said pizza box so that each said tab rests upon a corner zone;

(h) placing said second pizza on said platform;

in step (f), when said tabs are placed in said support position, open spaces being created in said platform, and after step (h) said open spaces (1) permitting convectional heat to pass between said first pizza and said second pizza, and (2) providing a finger hold for removing said platform from said pizza box; and, after step (h), inserting a finger in one of said open spaces and another finger in another of said open spaces and lifting said platform and said second pizza out of said pizza box.

9. Method for packaging two pizzas, comprising:

(a) providing a rectangular pizza box having four corner zones;

(b) providing a first pizza;

(c) providing a second pizza;

(d) providing a device for supporting said second pizza, said device including a rectangular platform which is shaped and dimensioned to be received by said pizza box, said platform having at least four tabs, said tabs selectively positionable to a support position which is substantially perpendicular to said platform, and said tabs located on said platform so that when said tabs are placed in said support position and said platform is placed inside the pizza box at least one said tab will rest upon each corner zone;

(e) placing said first pizza in said pizza box;

(f) placing said tabs in said support position;

(g) placing said platform in said pizza box so that each said tab rests upon a corner zone;

(h) placing said second pizza on said platform;

in step (d), said tabs oriented so that when said tabs are placed in said support position of step (f), said two tabs in each corner zone are perpendicular to one another;

in step (d), each said two tabs in each corner zone providing adjacent open spaces for a finger hold and a thumb hold with a web of platform between for removing said platform from said pizza box by pinching said web between a finger and a thumb; and, after step (h), inserting a finger in one of said open spaces and a thumb in an adjacent open space and pinching said web between the finger and the thumb, inserting another finger in another of said open spaces and another thumb in an adjacent open space and pinching said web between said open spaces and lifting said platform and said second pizza out of said pizza box.

10. Method for packaging two pizzas, comprising:

(a) providing a rectangular pizza box having four corner zones;

(b) providing a first pizza;

(c) providing a second pizza;

(d) providing a device for supporting said second pizza, said device including a rectangular platform which is shaped and dimensioned to be received by said pizza box, said platform having at least four tabs, said tabs selectively positionable to a support position which is substantially perpendicular to said platform, and said tabs located on said platform so that when said tabs are placed in said support position and said platform is placed inside the pizza box at least one said tab will rest upon each corner zone;

(e) placing said first pizza in said pizza box;

(f) placing said tabs in said support position;

(g) placing said platform in said pizza box so that each said tab rests upon a corner zone;

(h) placing said second pizza on said platform;

in step (d), each said tab including a central portion and two side tabs which are positionable perpendicular to said central portion to form a U-shaped-support upon which said platform can rest; and, in step (f), folding said side tabs to form said U-shaped support.

* * * * *